United States Patent [19]

Harding et al.

[11] 4,048,364

[45] Sept. 13, 1977

[54] POST-DRAWN, MELT-BLOWN WEBS

[75] Inventors: John W. Harding; James P. Keller, both of Baytown, Tex.

[73] Assignee: Exxon Research and Engineering Company, Linden, N.J.

[21] Appl. No.: 651,328

[22] Filed: Jan. 21, 1976

Related U.S. Application Data

[63] Continuation of Ser. No. 534,835, Dec. 20, 1974, abandoned, which is a continuation of Ser. No. 261,875, June 12, 1972, abandoned.

[51] Int. Cl.[2] ..... B32B 7/14

[52] U.S. Cl. ..... 428/113; 156/244; 428/198; 428/288; 428/296; 428/903; 428/910

[58] Field of Search ..... 428/225, 113, 198, 288, 428/212, 296, 903, 910; 156/244

[56] References Cited

U.S. PATENT DOCUMENTS

| | | | |
|---|---|---|---|
| 3,704,198 | 11/1972 | Prentice | 428/198 |
| 3,715,251 | 2/1973 | Prentice | 156/62.8 |
| 3,795,571 | 3/1974 | Prentice | 428/296 |

*Primary Examiner*—James J. Bell
*Attorney, Agent, or Firm*—David A. Roth; Ben C. Cadenhead

[57] ABSTRACT

A novel nonwoven article useful as a scrim support for other materials, such as paper toweling and wiping cloths, or as porous, nonadsorbent coverings for adsorbent packaging such as bandages or sanitary napkins, or a ribbon for packaging and decorative applications, is produced by post drawing certain melt-blown thermoplastic mats under defined conditions of draw ratios and temperatures. A moderate strength yarn or twine can be produced by twisting the post-drawn, melt-blown thermoplastic web.

1 Claim, 8 Drawing Figures

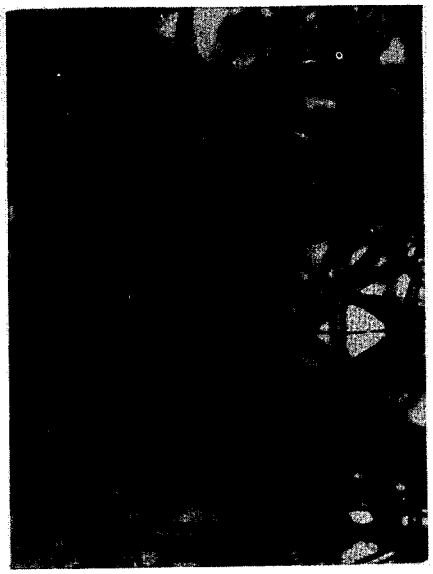
FIG. 3.
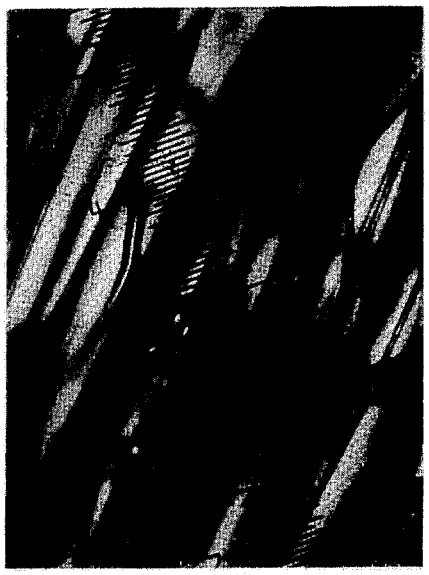
FIG. 4.
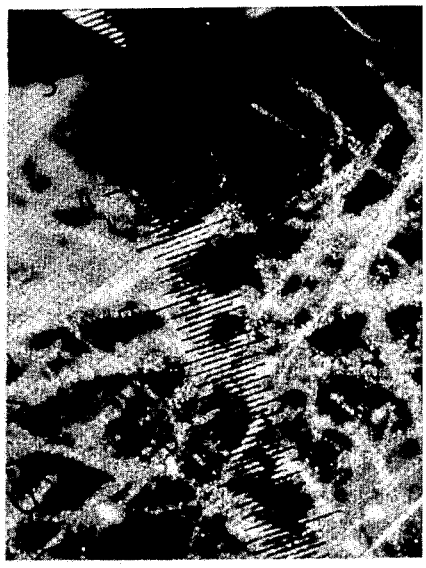
FIG. 5.
FIG. 6.
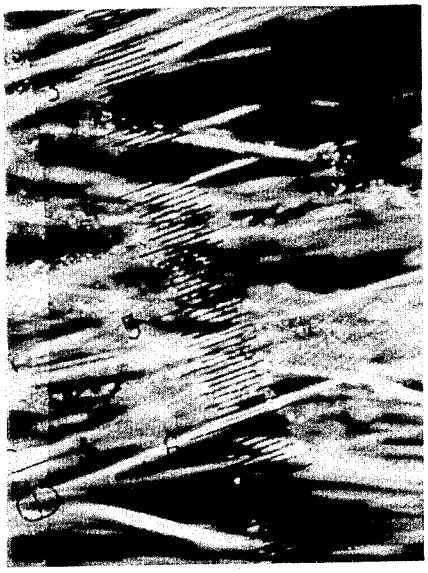
FIG. 7.
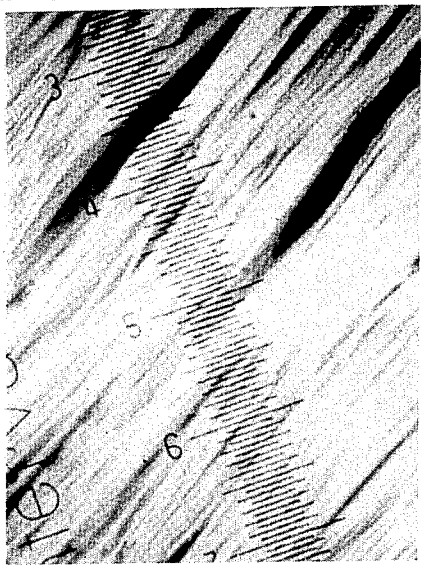

EFFECT OF DRAWING ON STRENGTH OF MELT BLOWN WEBS

POST-DRAWN, MELT-BLOWN WEBS

Related Applications

This is a continuation of application Ser. No. 534,835, filed Dec. 20, 1974, which is a continuation of application Ser. No. 261,875, filed June 12, 1972, both now abandoned.

This application is not formally related to any other application, but it is an improvement over inventions described in other copending, commonly assigned applications.

BACKGROUND OF THE INVENTION

1. Field of the Invention

The present invention is directed to the process and articles resulting therefrom of post drawing certain melt-blown thermoplastic mats which must be produced under selected process conditions so as to give a highly self-bonded web of essentially continuous, relatively large thermoplastic fibers.

2. Description of the Prior Art

A melt-blowing process for producing mats of polymer fibers is disclosed in an article entitled "Superfine Thermoplastics," by Van A. Wente, in *Industrial and Engineering Chemistry,* Vol 48, No. 8 (1956), Pages 1342–1346. Similar disclosures are found in two Naval Research Reports.

British Pat. No. 1,055,187 discloses a blowing process used in the formation of nonwovens of melt spun fibers.

SUMMARY OF THE INVENTION

The present invention is directed to the process of post drawing a web which has been produced by melt blowing a thermoplastic polymer under controlled conditions so as to produce a highly self-bonded, preferably nonwoven mat, made of essentially continuous, relatively large diameter thermoplastic fibers. This mat is subsequently drawn within defined ranges of temperature and draw ratios. The resulting product of the present invention is a soft, glossy ribbon having substantially uniform, parallel, fine fibers in a substantially longitudinal direction interspersed with coarse fiber junction points. The ribbon product is much stronger in its longitudinal direction than in its transverse direction and will have a tenacity in the order of 2 grams per denier.

BRIEF DESCRIPTION OF THE DRAWINGS

FIGS. 3–7 are photo micrographs of the article of the invention as well as the web from which it is formed.

DESCRIPTION OF THE PREFERRED EMBODIMENTS

Although the melt-blowing process per se is not a part of the present invention, sufficient descriptive background is included to understand the process without the necessity for extensive referrals to extraneous material.

Figure 1:
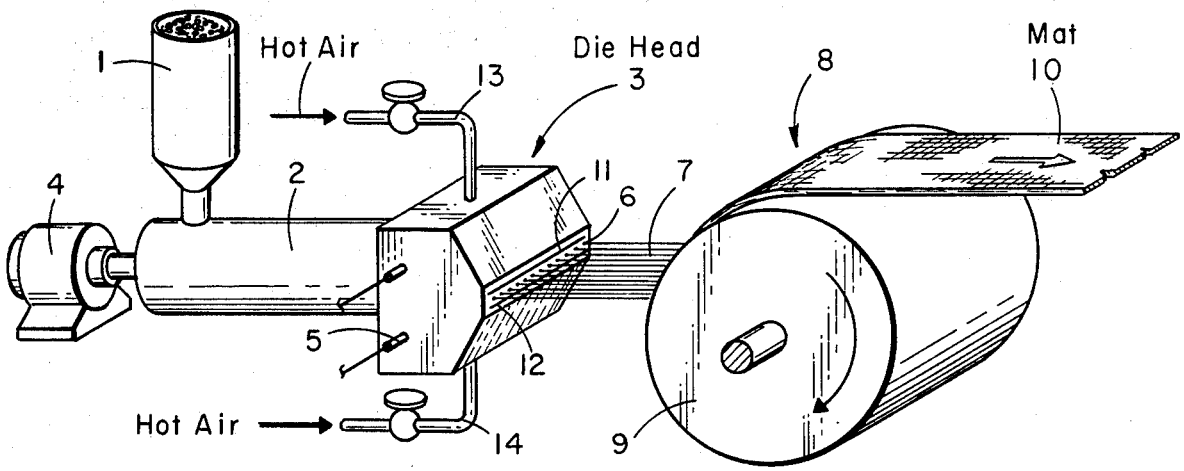
FIG. 1 is a schematic perspective view of the overall melt blowing process.

Referring to FIG. 1 of the drawings, in standard operation a thermoplastic polymer is introduced into a pellet hopper 1 of an extruder 2. The thermoplastic polymer is forced through the extruder 2 into a die head 3 by a drive 4. The die head 3 may contain heating means 5 which may control the temperature in the die head 3.

The thermoplastic polymer is then forced out of a row of die openings 6 in the die head 3 into a gas stream which originates from orifices contiguous to the die openings. This stream attenuates the thermoplastic polymer into fibers 7 which are collected on a moving collecting device 8 such as a drum 9 or a screen to form a continuous mat 10.

Figure 2:
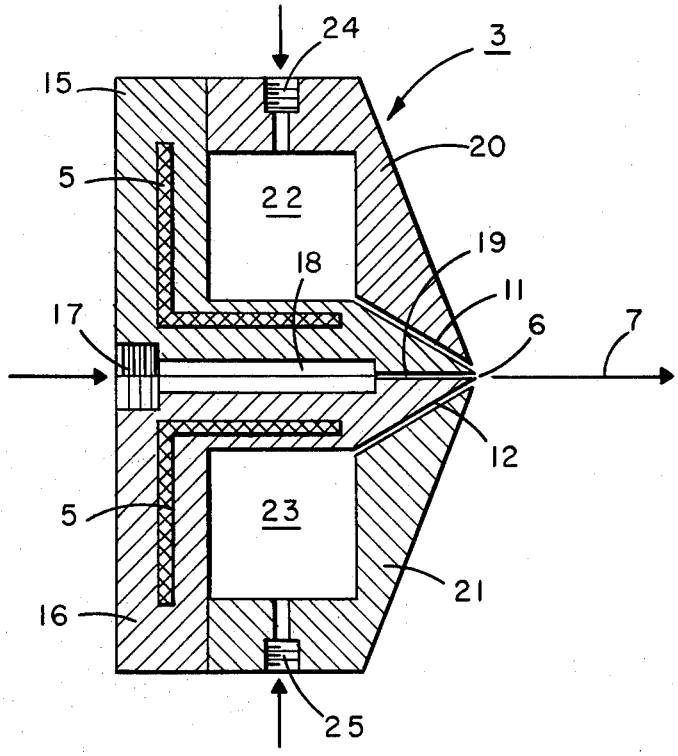
FIG. 2 is a detailed view in longitudinal cross section of a die which may be used in the melt-blowing process.

The gas stream which attenuates the thermoplastic polymer is supplied through gas jets 11 and 12, respectively, which are more clearly seen in FIG. 2. The gas slots 11 and 12 are supplied with a hot gas, preferably air, by gas lines 13 and 14, respectively.

In FIG. 2, the die head 3 is formed of upper die plate 15 and lower die plate 16. The thermoplastic polymer is introduced in the back of the die plates 15 and 16 through an inlet 17 as a result of the forcing action of extruder 2 at the back of the die plate 3. The thermoplastic polymer then goes into a chamber 18 between the upper and lower die plates 15 and 16 respectively. The facing of the die plate 16 can have milled grooves 19 which terminate in the die openings 6. It is understood, of course, that the milled grooves can be in the lower die plate 16 or the upper die plate 15, or that grooves can be milled in both plates 15 and 16. Vertically divided die heads can also be used.

Still further, if a single plate is used in place of the upper and lower die plates, the grooves can be drilled to produce the die openings 6. An upper gas cover plate 20 and a lower gas cover plate 21 are connected to the upper die plate and lower die plate 15 and 16, respectively, to provide an upper air chamber 22 and a lower air chamber 23 which terminate in the gas slots 11 and 12, respectively.

The hot gas is supplied through inlet 24 and upper gas cover plate 20 and inlet 25 and lower gas cover plate 21. Suitable baffling means (not shown) may be provided in both the upper air chamber 22 and the lower air chamber 23 to provide a uniform flow of air through the gas slots 11 and 12, respectively. The die head 3 can contain heating means 5 for heating both the thermoplastic polymer and air in the die head 3.

In general, the detailed melt-blowing process is carried out in accordance with the procedures described in Ser. No. 227,769 filed Feb. 22, 1972, the disclosure of which is hereby incorporated by reference in its entirety.

The particular operating conditions chosen in the melt blowing process will control the characteristics of the nonwoven thermoplastic polymer mats produced by that process.

In accordance with this invention, the thermoplastic resin is melt blown in the melt-blown apparatus as is described hereinbefore so as to produce a nonwoven mat having particularly well bonded fibers having average diameters of from about 10 to about 40 microns, preferably from about 15 to about 25 microns.

In operating the melt-blowing process to produce a nonwoven mat having fibers with average diameters in the range between about 10 to about 40 microns, the gas flow rates for a given molten polymer flow rate are adjusted to obtain the desired fiber.

The polymer flow rate, the rate at which the thermoplastic resin is forced through the die openings 6 in the die head 3, is dependent upon the specific design of the die head 3 and extruder 2.

However, for polypropylene suitable polymer flow rates from about 0.07 to about 0.5 or more gm/min/opening. The polymer flow rate is controlled not only by the speed of the extruder, but by other factors discussed at length in Ser. No. 227,769. In general, for the process of this invention, the lower air rates described in Ser. No. 227,769 are preferred. The gas flow rate is limited by the design of the die head 3.

Suitable products, for instance, have been obtained at air rates from about 0.2 to about 6 lbs/min. or greater for a four inch, 80 hole die, and up to about 15 lbs/min. for a 10 inch, 200 hole die, and up to about 60 lbs/min. for a 40 inch, 800 hole die.

Air rates of this magnitude attenuate the molten thermoplastic resin extruded through the die openings 6 into relatively large fibers as melt-blown fibers go, having average diameters in the range of from about 10 to about 40 microns.

When the air rates for a given polymer flow rate are too low, large coarse fibers are formed which entwine into coarse, ropey bundles, or "rope," that produce a coarse, nonpliable, brittle, irregular mat structure. As the air flow rate is increased and passed out of the air flow rate range which produces the large coarse fibers, precursor nonwoven mats are produced having essentially continuous fibers.

When the air rates for a given polymer flow rate are too large, the attenuated fibers break and become discontinuous and produce large, objectionable shot in the nonwoven mat. The shot may be as large as 1 millimeter in diameter. Articles of the invention will tend to tear at points where shot forms.

In another air regime, with even higher air rates, relative to the polymer flow rate, the shot gets much smaller and acceptable nonwoven mats composed of very fine fibers from about 1 about 10 microns are formed, but having very different physical characteristics. Mats comprised of these short, fine fibers are not suitable for the process and articles of the invention.

Herein, polypropylene resin is used as a specific embodiment to illustrate the present invention. However, other fiber-forming thermoplastic resins can be used in the present invention.

Examples of other suitable resins include other polyolefins such as polyethylene, polybutene, polymethylpentene, ethylene-propylene copolymers, polyesters such as poly(methylmethacrylate) and poly(ethyleneterephthalate), polyamides such as poly(hexamethylene adipamide), or poly($\alpha$-caproamide) or poly(hexamethylene sebacamide), polyvinyls such as polystyrene, and other thermoplastic polymers such as polytrifluorochloroethylene and mixtures thereof.

In operating the melt-blowing process to produce the nonwoven mat desired, the control of the appropriate combination of die tip temperature, resin flow rate, and resin molecular weight is made so as to give an apparent viscosity of the thermoplastic resin in the die holes of from about 10 to about 800 poise, preferably within the range of from about 50 to about 300 poise.

For a particular thermoplastic resin, the apparent viscosity is calculated from the geometry of the die by methods well known in polymer rheology by measuring the pressure upstream of the die holes, and by measuring the polymer flow rate. See, e.g., both H. V. Boenig, *Polyolefins,* p 264 (1966), and *Chemical Engineering Handbook* (Perry Ed. 1950) at p. 375. The apparent viscosity can usually be adjusted into the operable range by varying the die tip temperature. See Ser. No. 227,769 for details.

To be melt blown into fibers, polypropylene, it has been found, must be thermally treated at temperatures in excess of 550° F., and preferably, within the range of from about 575° to about 800° F. The degree of thermal treatment necessary varies with the melt index of the particular polypropylene resin employed and with the polymer rates used in the melt-blowing process. The thermal treatment of the polypropylene may be carried out in the extruder 2 alone, or partially in the extruder 2 and partially in the die head 3.

After rate of air flow relative to the rate of molten polymer flow, the next single most important factor in producing a suitable precursor nonwoven mat for making the present inventive article is the rate of cooling of the fibers as they are extruded, attenuated, and matted.

In short, rapid cooling (i.e., quenching) of the fibers is necessary. This is conveniently accomplished by a twofold approach. First, the distance separating the collecting device 8 from the die openings 6 in the die head 3 must be carefully controlled. If the distance is too small between the collecting device 8 and the die openings 6, the rate of cooling may be too slow. On the other hand, if the distance is too great, while sufficient cooling may be obtained there may be no bonding between fibers as the nonwoven mat is produced.

Self-bonding of the fibers in the nonwoven mat so produced is according to the present invention a very desirable physical characteristic and is the third process characteristic in importance, with respect to affecting the final characteristics of the article of the invention. It has been found that for obtaining satisfactory self-bonded products from a 4 inch die, the distance between the collecting device 8 and the die openings 6 should range between 3 and 12 inches.

Supplementary cooling to obtain the proper amount and extent of bonded fibers in the nonwoven mat is preferably used in conjunction with proper die to collector distances used. Such secondary cooling can be accomplished with a water quench or preferably with dry ice within the collecting device 8 or associated with it. Of course, refrigerant coils could also be built into the collection device.

The nonwoven mat produced by the special, above-described process has continuous fibers of low crystallinity. (Rapid cooling inhibits formation of spherulites and crystallites in the fibers.) Thus, a great deal of attention must be given to critical process detail in order to produce nonwoven mats which will be satisfactory precursors for the nonwoven article of the invention.

The precursor nonwoven mat is then drawn while being subjected to heating.

Drawing can be done in a hot air oven or the nonwoven mat may be drawn over a heated draw bar. The drawing operation may be in line or a separate operation wherein the nonwoven mat is collected on a roll at a higher rate of speed than that feeding the drawing means. In any event, the nonwoven mat is drawn at draw ratios from about 2:1 to about 10:1 and preferably between about 5:1 and about 7:1. The temperature will be from slightly below the softening point of a given polymer down to a temperature where the precursor mat is pulled apart rather than drawn. For polypropylene, the temperature will be from about 200° to 375° F. preferably 230° to 350° F., and most preferably 250° to 310° F.

The resulting nonwoven article is a soft, glossy ribbon. It is useful as a scrim support for use in paper toweling, wiping cloths, other nonwovens, or as a porous, non-absorbent coating for absorbent packaging such as bandages or sanitary napkins, or as a ribbon or packing and in decorative applications.

The article of the invention can be twisted into yarns which can be used for tufted carpets and twine. In its ribbon form, it can be used decoratively or to weave carpet backing and containers such as sand bags and vegetable bags. It also can be used for netting, such as mosquito netting, filter paper, etc. Furthermore, it can be used for surgical implantations.

The process and resin should be chosen to prepare a precursor web which can be characterized as having:

a. a breaking length of from 600 to 2000, preferably 700 to 1500, and most preferably 900 to 1300 meters; (Breaking length is the length of a particular nonwoven structure which will cause breaking at any place because of the weight of the structure itself.)

b. at least 50, preferably at least 70, and most preferably at least 110 percent elongation before break while being pulled; and the ability to break sharply at such elongation, as contrasted to simply being pulled apart.

The elongation and tensile tests on the precursor web as well as the ones on the resultant article are carried out on an Instron testing machine with the jaws set 4 inches apart. This is a standard technique. The Instron apparatus and test is described in ASTM D76-67 and ASTM D 2256-69. The test apparatus is obtainable from: Instron Corp., 2500 Washington St., Canton, Mass. 02021.

After elongation, the fibers in the longitudinal direction will have an average diameter of about 1 to 8, and most preferably 3 to 8 microns. The transverse fibers will essentially retain their average diameters before elongation, i.e., about 10 to 40 microns on the average.

Self-bonded refers to the phenomenon of two fibers crossing each other at at least one junction point and being bonded to each other by their ability to fuse thermoplastically to each other at temperatures which soften them and under drawing tensions.

The invention is further illustrated by the following specific examples, which should not be taken as limitations on the scope of the invention.

EXAMPLE 1

A 20 MFR (melt flow rate) polypropylene resin was used in an apparatus similar to that of FIGS. 1 and 2.* It was thermally treated to 56 MFR in one extruder and then fed to the melt-blowing extruder. The particular melt-blowing die used had 80 holes along a 4-inch nose and 0.010 inch air slots on either side of the polymer holes.

A web was blown under the following conditions:

| | |
|---|---|
| Melt-blowing extruder temperature | 450° F. |
| Die Temperature | 680° F. |
| Polymer Rate | 6.7 gms./min. (total) |
| Die to Collector Distance | 4 inches |
| Air Rate | 0.6 lbs./min. (total) |

Crushed dry ice was put in the collector screen to help quench the web.

The resulting precursor nonwoven web was then drawn in an oven 6 feet long maintained at 250° F. The web was fed at 40 feet/minute and withdrawn at 260 feet/minute. The entering web was about 4.5 inches wide and fairly stiff. The final drawn web was about 1-¼inches wide, extremely flexible and glossy in appearance. This drawn article had a denier of 3320 and a tenacity of 1.5 gms/denier. FIGS. 3 to 7 which are photomicrographs (200×) of the precursor web and drawn web article of this invention indicate the profound changes which take place in the precursor webs. These figures are described in detail as follows:

FIG. 3 Transmitted light passed through the undrawn web; shows random directions and loops in fibers. Fiber diameters are about 8 to 15μ.

FIG. 4 Transmitted light through the drawn web; shows thin drawn fibers (about 4 to 8μ) aligned with the machine direction, and thicker less drawn fibers looped generally in the cross direction of the web.

FIG. 5 Polarized transmitted light through the undrawn web; shows the lack of orientation within the fibers. The small Maltese cross patterns show that small domains are partially crystallized. There was about 22% crystallinity found by X-ray in this sample.

FIGS. 6 and 7 Polarized transmitted light through the drawn web. FIG. 6 is with the machine direction of the web parallel to the polarizer and perpendicular to the analyzer for minimum brightness of the drawn machine direction fibers.

This shows the small maltese cross pattern on some undrawn segments at bonded points.

FIG. 7 is with the machine direction of the web at 45° to the polarizer and analyzer for maximum brightness of the drawn machine direction fibers. This shows that the fiber morphology is highly oriented along the fiber longitudinal axis as well as the fact that the majority of the fibers are parallel. The X-ray crystallinity of the drawn web was 47%.

The undrawn webs had about 15–22% monoclinic crystallinity by X-ray and microscope. After drawing at 6 or 7/1 the crystallites went up to 48–57% monoclinic. Based on drawing of monofilament or film it would be advantageous to have the paracrystalline structure in the undrawn webs. Attempts to obtain this by putting solid $CO_2$ in the collector screen to try for a quick quench gave no change in the X-ray pattern. It is noted in passing that the dry ice allowed the collection of a good web 2 inches from the die. However, the web collected 4 inches away with all other variables constant was stronger.

As can be seen by the photomicrographs, drawing affects the web and the individual fibers. First, it changes the random network of fibers into an array of fibers which run predominantly in the machine direction. This is observed also by the narrowing of the web. Secondly, the individual fibers are drawn down to smaller diameter and the crystalline structure is developed and oriented. Those fibers which remain perpendicular to the machine direction are neither drawn nor oriented.

In a sample which was drawn at 6.6/1, the average fiber diameter was reduced from 16 μ to 5.7 μ. The undrawn web showed spherulitic structure or almost zero birefringence on the main strands. After drawing, the birefringence averaged $41 \times 10^{-3}$. Based on the usual birefringence of drawn fibers ($20$ to $35 \times 10^{-3}$), this sample had very high orientation. There is, however, no unique correlation of birefringence with strength to allow an absolute value to be put on the strength of these fibers. The upper limit on birefringence of polypropylene is reported to be somewhere between 15 and 67 $\times 10^{-3}$.

Unless otherwise indicated, draw ratios are machine draw ratios.

EXAMPLE 2

The procedure of Example 1 was repeated exactly except that the withdrawal rate was 260 ft./min.

A twisted piece of the resulting ribbon had a tenacity of 1.84 grams per denier and a denier of 2860. (All samples in these examples were tested in standard monofilament instruments using a twisted portion of sample.)

EXAMPLE 3

To further illustrate the effect of drawing on the strength of the resulting articles, a series of precursor webs produced from polypropylene resin of different shear stress and die swells were drawn at various machine draw ratios (MDR) between 2 and 7 and at different temperatures.

Figure 8:
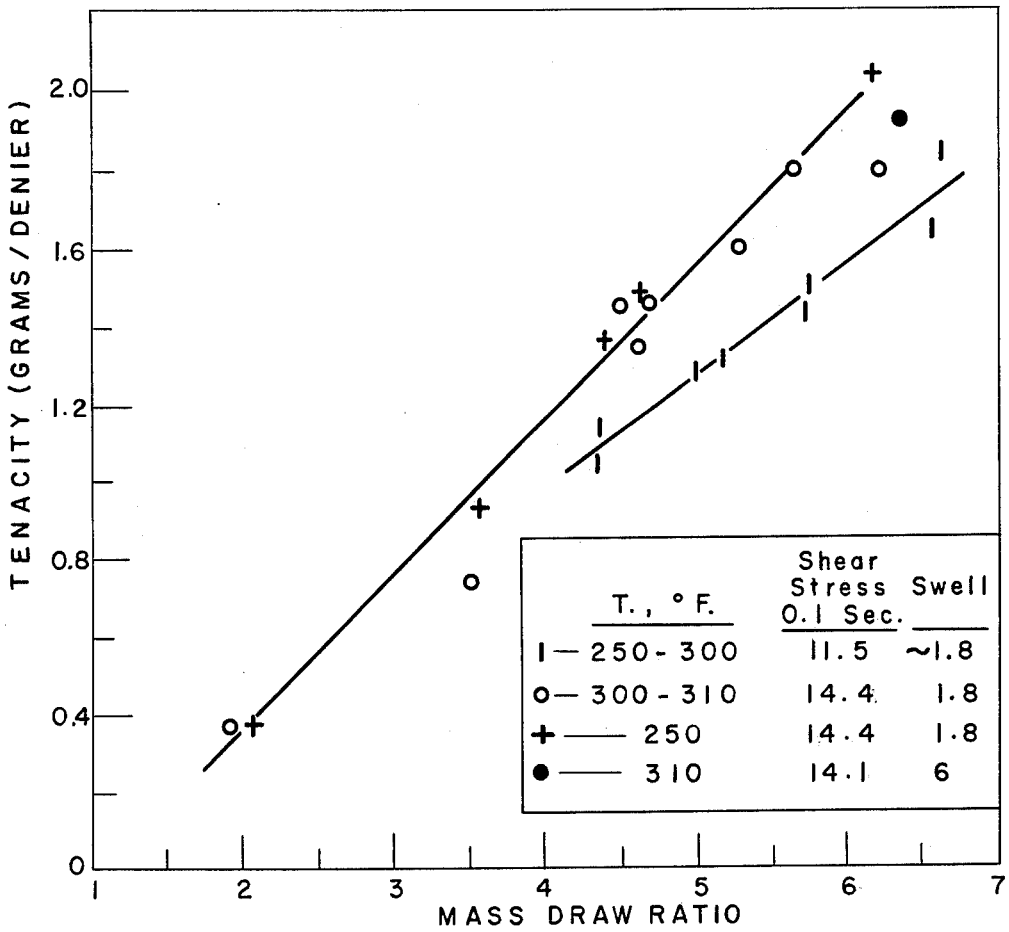
FIG. 8 is a graph showing how strength increases with increased draw ratios.

The feed was held at 40 feet/minute and the take-up speed varied to vary the draw ratio. The results were plotted and are schematically shown in the graph of FIG. 8.

The results of these series are shown as tenacity plotted against mass draw ratio instead of the more usual machine draw ratio. The mass draw ratio (undrawn/drawn web weight per unit length) was used to give a smooth curve. Since only short lengths (~100–200 feet) were drawn and were not collected under tension there may have been transient conditions during the draw or variations in relaxation. Most data showed the two ratios differing by less than 15%, but 4 points showed the mass draw to be up to 34% lower than the MDR but using mass draw ratio still gave essentially smooth linear relationships.

The low swell, 14.4 shear stress polymer gave increases in tenacity up to 2 grams per denier at 6:1 mass draw ratio. It is also seen that drawing oven temperatures of 250° F. and 300° F. had no effect on the strength. Initial screening had shown that temperatures between 200° and 300° F. had no effect on strength. Also the webs could not be drawn at room temperature or at 350° F.

When the low swell resin was degraded further to 11.5 standard shear stress, the product strength and slope of strength versus draw ratio decreased. This indicates that it is worthwhile directionally to increase the molecular weight in the web as measured by shear stress. Increase in viscosity average molecular weight, i.e., Mv, does not result in additional strength.

The single point shown for the high swell resin is the average of 6 different webs drawn between 6:1 and 6.8:1. These webs were made during an attempt to melt blow a higher molecular weight high swell resin. By running the extruder at 590° F. and the die at 550°–600° F. it was possible to form acceptable webs. The results of the drawing were 1.93 grams/denier, 26% elongation at an average of 6.35:1 mass draw ratio.

Most good webs could be run fairly well at 6/1 MDR but broke fairly often at 7/1. This appeared to be caused by uneven points in the web or the contacting of the fluttering web with oven parts.

EXAMPLE 4

A series of webs were made from polypropylene resin to determine the effect of basis weight. Basis weight is a measure of mass and is calculated from the formula $$\frac{155 \times \text{weight}}{\text{weight} \times \text{width}}.$$

Basis weight is related to denier. And the object of this example was to determine whether denier influenced strength. Denier is the weight of 9,000 meters of a particular fabric. These webs were made of varying basis weights by running the collector at varying speeds while holding all other conditions constant. The conditions were chosen to result in satisfactory precursor webs according to the criteria set forth above. The webs were drawn in a drawing oven at 310° F. and the results were set forth in Table I below:

TABLE I

Effect of Basis Weight on Drawn Tenacity

| Undrawn Web | | Machine | Drawn Web | | Calculated |
|---|---|---|---|---|---|
| Denier | IV | DR | Mass DR | Tenacity g.p.d. | Tenacity at 6/1 Mass DR, g.p.d. |
| 9,550 | 0.95 | 7 | 0.05 | 1.64 | 1.62 |
| 17,200 | 1.00 | 7 | 4.86 | 1.69 | 2.14 |
| 31,600 | 0.98 | 7 | 5.96 | 2.28 | 2.30 |
| 53,400 | 1.07 | 7 | 4.45 | 1.48 | 2.09 |

DR = draw ratio
IV = inherent viscosity
g.p.d. = grams per denier

The results of drawing at 310° F. are shown in Table I. To compare tensiles at the same mass draw ratio the experimental values were corrected to a 6/1 mass draw ratio by assuming that the slope from FIG. 8 for this resin would apply to each data point. In the last column it is seen that the tenacity rises sharply between 9,500 and 17,000 undrawn denier and remains above 2.09 up to 53,400 denier. There is apparently a maximum between 17,000 and 50,000 denier.

Thus, the special melt-blown webs can be drawn to about 6 or 7/1 to yield a product with a machine direction tenacity of 2 grams per denier or more. Tenacity increases with (1) shear stress of the base resin, (2) with draw ratio within the operable limits and (3) with denier at low deniers (10–17,000). Temperature of draw has no appreciable effect on strength between the operating ranges.

We claim:

1. A soft, glossy ribbon having substantially uniform, parallel, fine polypropylene fibers in a substantially longitudinal direction interspersed with coarse fiber junction points wherein said ribbon is much stronger in its longitudinal direction than in its transverse direction and is much stronger in said longitudinal direction as compared to a precursor, non-woven polypropylene, melt-brown article made from a melt-blowing process, which precursor article comprises a. a mass of self-bonded, polypropylene fibers in a random network with said fibers
   i. having an average diameter of 10 to 40 microns
   ii. with little or no crystallinity and orientation,
b. having a breaking length of from 600 to 2,000 meters,
c. an elongation before break of at least 50%, and an ability to break sharply at said elongation, and
d. a tenacity of less than 0.4 grams per denier, said ribbon having a. fibers in the longitudinal direction having an average diameter of 1 to 8 microns and being relatively strong, fine, oriented and crystalline, and b. fibers in the transverse direction having an average diameter of 10 to 40 microns and being relatively coarse, weak and with little or no crystallinity and orientation, said transverse fibers being essentially of the same physical characteristics of those of said precursor non-woven article before conversion to said ribbon, and c. said ribbon having a tenacity of at least 1.6 grams per denier in the longitudinal direction wherein the improved properties of said ribbon as compared to said precursor article are obtained by drawing said precursor article at a draw ratio of from 2:1 to 10:1 at a temperature of 200° to 370° F.

* * * * *